US007362297B2

(12) United States Patent
Koyama

(10) Patent No.: US 7,362,297 B2
(45) Date of Patent: Apr. 22, 2008

(54) DISPLAY DEVICE

(75) Inventor: Jun Koyama, Sagamihara (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 487 days.

(21) Appl. No.: 10/687,655

(22) Filed: Oct. 20, 2003

(65) Prior Publication Data

US 2004/0080500 A1 Apr. 29, 2004

(30) Foreign Application Priority Data

Oct. 21, 2002 (JP) ..... 2002-306337

(51) Int. Cl.
*G09G 3/36* (2006.01)

(52) U.S. Cl. ..... 345/92; 345/93; 345/89; 345/98; 345/100

(58) Field of Classification Search ..... 345/204, 345/92, 211–214, 210, 93, 87, 99, 100, 132, 345/98, 89, 147, 690, 691, 84; 327/536; 349/172, 149; 257/350, 359; 427/96
See application file for complete search history.

(56) References Cited

U.S. PATENT DOCUMENTS 5,343,217 A * 8/1994 Kim ..... 345/95
5,349,366 A * 9/1994 Yamazaki et al. ..... 345/92
5,583,424 A 12/1996 Sato et al.
5,859,626 A * 1/1999 Kawamura ..... 345/99
6,339,422 B1 * 1/2002 Kuwajima et al. ..... 345/204
6,522,319 B1 2/2003 Yamazaki
6,573,970 B1 * 6/2003 Saitoh et al. ..... 349/172
6,577,072 B2 6/2003 Saito et al.
6,693,412 B2 2/2004 Ruan et al.
6,909,413 B2 * 6/2005 Nanno et al. ..... 345/87
7,042,162 B2 5/2006 Yamazaki et al.
7,084,848 B2 8/2006 Senda et al.
7,126,595 B2 10/2006 Yanagi et al.
7,148,886 B2 12/2006 Nakajima
7,205,989 B2 4/2007 Nakajima
2001/0003446 A1 * 6/2001 Takafuji ..... 345/98
2001/0007432 A1 * 7/2001 Ayres ..... 327/536
2001/0026835 A1 * 10/2001 Tanaka ..... 427/96

(Continued)

FOREIGN PATENT DOCUMENTS

CN 1308407 8/2001

(Continued)

OTHER PUBLICATIONS

Office Action (Application No. 200310102889.6) dated May 11, 2007.

*Primary Examiner*—Prabodh Dharia
(74) *Attorney, Agent, or Firm*—Eric J. Robinson; Robinson Intellectual Property Law Office, P.C.

(57) ABSTRACT

A display device of the present invention has an incorporated charge pump control circuit and a clock frequency of a switching element can be varied according to a display mode to reduce the power consumption. On the display device, a variable frequency-dividing circuit and a CPU to control the circuit are configured with thin film transistors. A clock frequency of a switching element is varied by controlling a dividing ratio of the variable frequency-dividing circuit on the basis of CPU data.

16 Claims, 10 Drawing Sheets

U.S. PATENT DOCUMENTS

2002/0036636 A1* 3/2002 Yanagi et al. ..... 345/211
2002/0044145 A1 4/2002 Tomio et al.
2002/0057235 A1* 5/2002 Murai et al. ..... 345/84
2002/0135574 A1 9/2002 Nakamura
2002/0145041 A1 10/2002 Muthu et al.
2002/0145602 A1 10/2002 Matsueday
2002/0154151 A1* 10/2002 Koyama ..... 345/690
2002/0158590 A1 10/2002 Saito et al.
2002/0175662 A1 11/2002 Sakurai et al.
2002/0175887 A1 11/2002 Yamazaki
2002/0180721 A1* 12/2002 Kimura et al. ..... 345/211
2003/0011586 A1 1/2003 Nakajima
2003/0053321 A1 3/2003 Ishiyama
2003/0058543 A1 3/2003 Sheedy et al.
2003/0063077 A1* 4/2003 Koyama ..... 345/204
2003/0067434 A1* 4/2003 Haga et al. ..... 345/98
2003/0116805 A1* 6/2003 Suzawa et al. ..... 257/350
2003/0164522 A1* 9/2003 Kato et al. ..... 257/359
2003/0174153 A1* 9/2003 Koyama ..... 345/690
2003/0201967 A1 10/2003 Yu
2004/0080500 A1 4/2004 Koyama
2005/0041002 A1 2/2005 Takaharah et al.
2005/0052447 A1 3/2005 Ishiyama
2005/0184943 A1 8/2005 Nakajima
2006/0077333 A1* 4/2006 Imajo et al. ..... 349/149
2006/0187172 A1 8/2006 Nakajima

FOREIGN PATENT DOCUMENTS

CN 1339934 3/2002
EP 0 923 067 6/1999
EP 1304791 4/2003
EP 1 376 529 1/2004
EP 1 180 762 6/2005
JP 11-202290 * 7/1999
JP 2002-175049 6/2002
WO WO 02/35507 5/2002

* cited by examiner

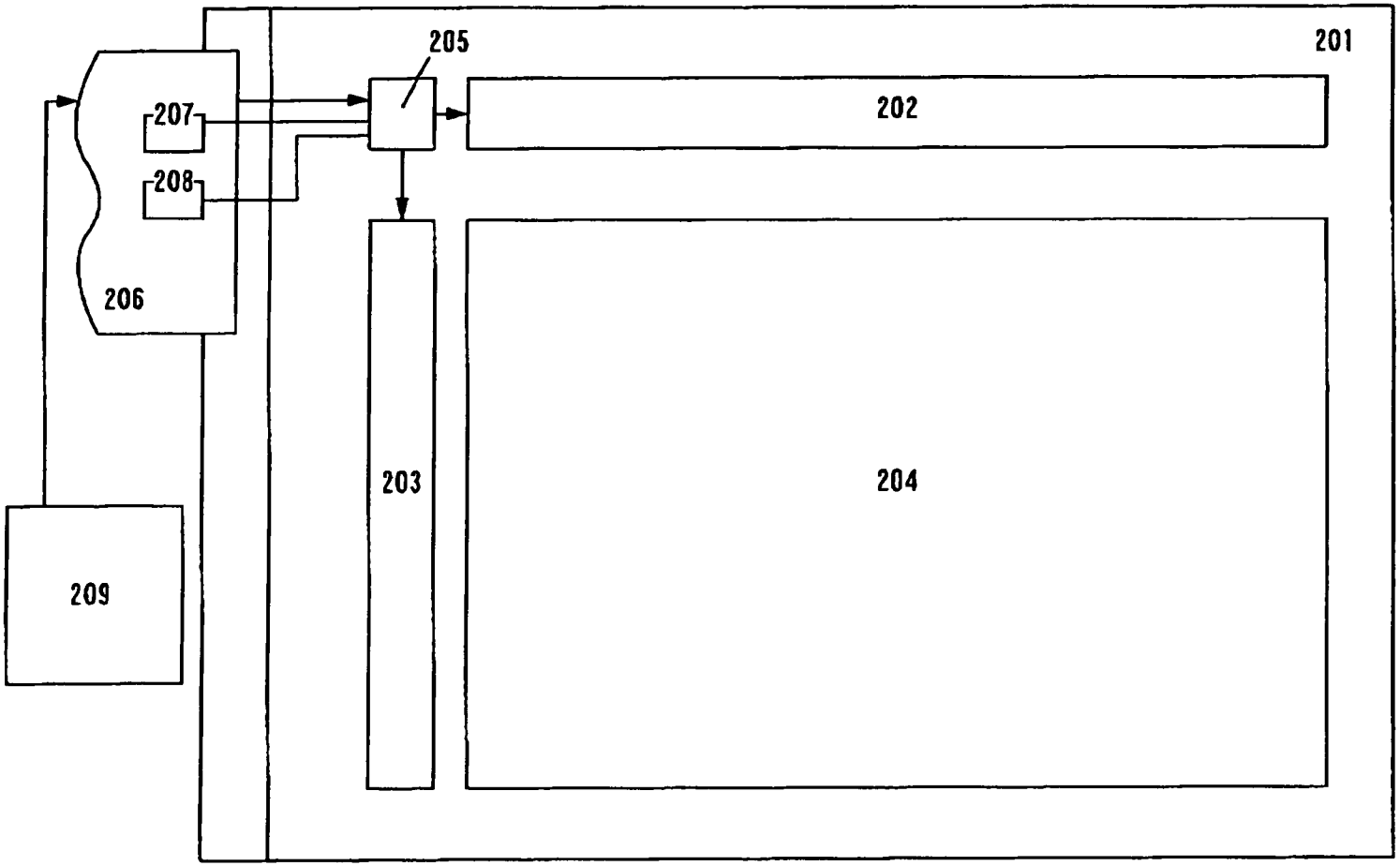
Fig. 2 --Prior Art--

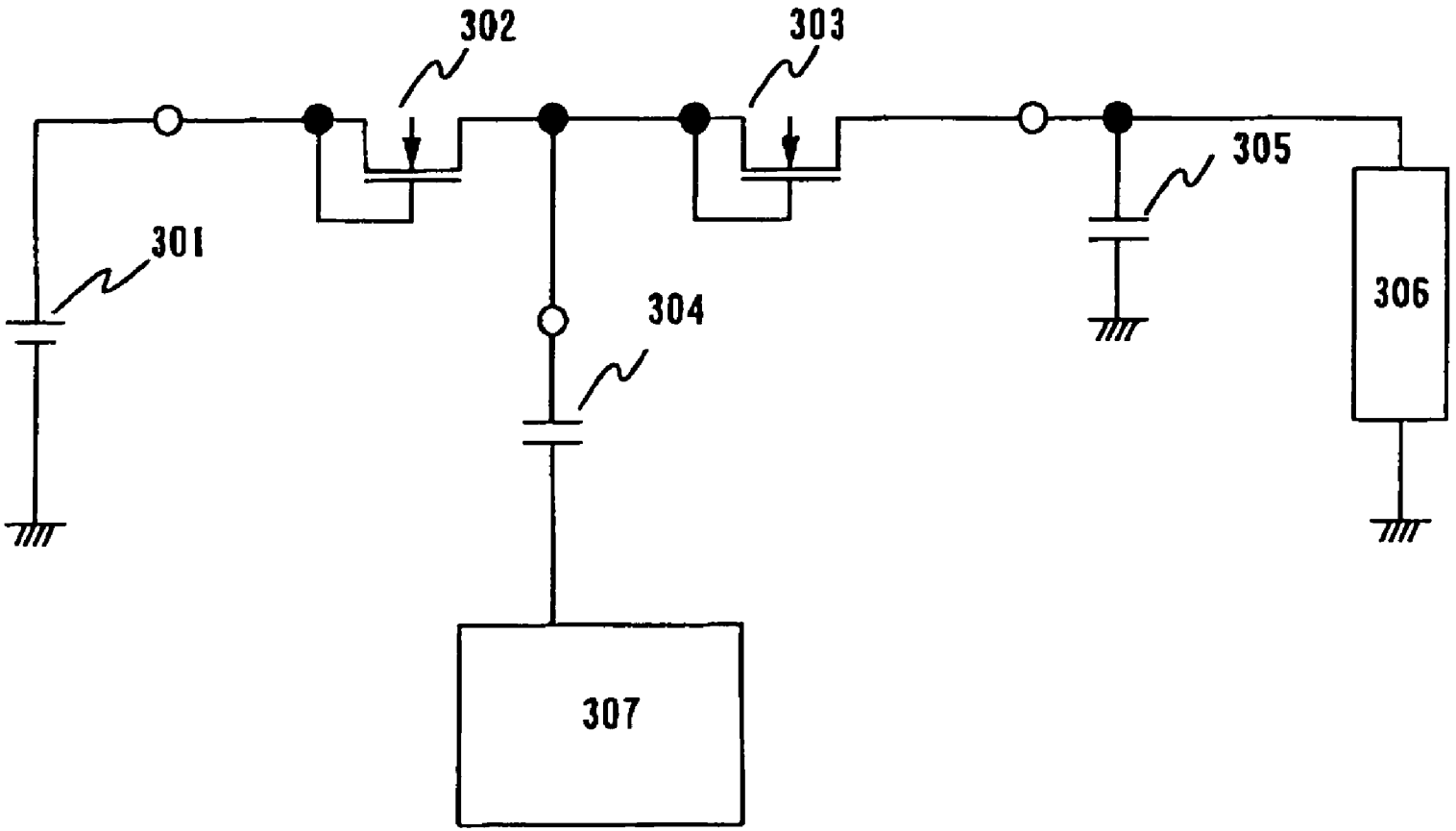
Fig. 3 --Prior Art--

DISPLAY DEVICE

BACKGROUND OF THE INVENTION

1. Field of the Invention

The present invention relates to a display device which has a power source circuit, and more particularly to a display device which has a charge pump control circuit formed of thin film transistors.

2. Description of the Related Art

In recent years, with the advance of the communication technology, mobile phones have been widely used. In future, transmission of moving images and transmission of a larger volume of information are expected. On the other hand, through reduction in weight of personal computers, those adapted for mobile communication have been produced. Information terminals called PDA originated in electronic notebooks have also been produced in large quantities and widely used. In addition, with the development of display devices, the majority of portable information devices are equipped with flat panel displays.

Conventionally, polycrystalline semiconductor films were formed at 1000° C. or more. However, in recent years, the films are formed at a low temperature of approximately 500° C. at highest. With the low-temperature polycrystalline semiconductor TFTs (Thin Film Transistor), manufacturing of an active matrix display device has been promoted. Such an active matrix display device has advantages in that, in addition to a pixel, a signal line driving circuit can be integrally formed around a pixel portion. Thus, since it is possible to realize downsizing and high definition of a display device, the display device is expected to be more widely used in future.

However, although a circuit to write a video signal to a pixel was incorporated in an original display device formed by using low-temperature polycrystalline semiconductor TFTs, a power source circuit or the like was not incorporated and it was provided as the externally attached part.

Generally, a lithium ion battery is used as a power source for portable equipment such as portable information equipment. The lithium ion battery normally outputs direct current voltages of approximately 3.6 V and is widely used for the advantages of a long life, a high-speed charge, a good retention characteristic and safety. However, to drive a material such as liquid crystal or organic EL (electro luminescence) used for a display device, the voltage of 3.6V is insufficient and voltage of 10V to 18V is required.

For the above reason, a display device as shown in FIG. 2 in which a charge pump circuit is configured on a substrate to supply voltages required for driving was developed. FIG. 2 is an outline view of the periphery of a display device of portable information equipment having a conventional charge pump. A pixel portion 204, a source signal line driving circuit 202, a gate signal line driving circuit 203, a switching element 205 are integrally formed on a substrate 201. Capacitors 207 and 208 are loaded on an FPC (Flexible Printed Circuit) 206. A clock generator 209 is provided outside the substrate 201. Note that the charge pump comprises the switching element 205 and capacitors 207 and 208.

FIG. 3 shows a conventional charge pump circuit. Here, switching elements are connected to drains/gates of N-type TFTs and used as diodes. The operation will be hereinafter described. First, a voltage of a power source 301 is applied to a capacitor 304 via a switching element 302. In the case where the voltage of the power source 301 is referred to as VDD and the voltage of the switching element is referred to as VF, a voltage of VDD-VF is applied to the both ends of the capacitor 304 when the output of a clock generator 307 is Lo. Next, when the output of the clock generator is Hi, a charge of the capacitor is applied to a load 306 and a capacitor 305 via a switching element 303. When the current flowing in the load is small enough, the charge of the capacitor 304 is retained, thereby a voltage of 2VDD-2VF generates at the both ends of the capacitor 305. In case of VDD>>VF, a voltage of nearly second times as high as VDD is generated in the load. Accordingly, a higher voltage than the original one can be obtained by using a charge pump. This is shown in FIGS. 4A and 4B.

SUMMARY OF THE INVENTION

A display device incorporating switching elements for a conventional charge pump as described above has the following problem.

A normal charge pump circuit does not have a function to feedback an output voltage and stabilize the output as other switching regulators. Therefore, a current load becomes heavy in value and stability of the power source is deteriorated when the output current becomes large.

FIG. 4B shows a waveform of the output voltage in the case where the load becomes heavy as above. As shown in FIG. 4B, the generation of ripples with a large clock cycle has damaging influence on a signal line driving circuit or the like which is driven by a charge pump circuit. To solve the problem, the clock frequency is set high and the switch operation and charging are frequently conducted so as to suppress the ripples.

Meanwhile, with respect to a portable display device such as a mobile phone, when no signal is inputted for a certain time after a screen saver is started, a normal display mode shown in FIG. 5A, for example, shifts to a power-saving mode which displays time only as shown in FIG. 5B. During the power-saving mode, the output current of the charge pump circuit can be suppressed since the power required to perform a display operation is lowered.

However, as described above, the clock frequency is set in consideration of the heaviest load. Therefore, during the power-saving mode, there is a problem in that the switch operation for the charge pump consumes relatively a large power.

To solve the foregoing problems, the inventors thought of using low-temperature polycrystalline semiconductor TFTs on a substrate of a display device in order to incorporate a charge pump control circuit as well as a switching element. The TFT formed of a polycrystalline semiconductor has high driving performance different from the one formed of an amorphous semiconductor. Thus, it is possible to configure a charge pump control circuit with low-temperature polycrystalline semiconductor TFTs.

In the display device of the above structure, during a normal display operation, switching elements are driven at a high clock frequency while retaining an output voltage of the charge pump. On the other hand, during a power-saving mode, the switching elements are driven at a low frequency while suppressing the power consumption of the charge pump circuit. By these operations, unnecessary current which flows in the whole circuit can be controlled, leading to the reduction in power consumption.

The structure of the invention will be hereinafter described.

According to the invention, a display device comprises a charge pump control circuit formed of a thin film transistor on a substrate.

According to the invention, a display device comprises a charge pump control circuit formed of the thin film transistor on a substrate, wherein a switching element is driven correspondingly to an output signal of the charge pump control circuit, thereby a voltage is stepped up or down.

According to the invention, a display device comprises a charge pump control circuit which can vary a clock frequency to input to the switching element.

According to the invention, a display device comprises a frequency varying unit which is controlled by a CPU (Central Processing Unit).

According to the invention, a display device comprises a CPU which is comprised of a thin film transistor.

According to the invention, a display device comprises a thin film transistor on a substrate, a variable frequency-dividing circuit and a CPU, wherein: the variable frequency-dividing circuit and the CPU are comprised of the thin film transistors; the variable frequency-dividing circuit is controlled by the CPU; and a dividing ratio is varied according to a display mode.

According to the invention, a display device comprises a thin film transistor on a substrate, and a switching element, wherein the switching element is a PIN diode (diode formed by a PIN junction).

According to the invention, the above display device has the PIN diode formed simultaneously with the thin film transistor.

According to the invention, the above display device is a liquid crystal display device.

According to the invention, the above display device is an EL display device.

The invention is electrical equipment using the above display device.

As set forth above, a charge pump circuit with low-power consumption according to a display mode is realized by incorporating the charge pump control circuit into a display device.

BRIEF DESCRIPTION OF THE DRAWINGS

FIG. 2 is an outline view of a conventional display device.

FIG. 3 is a configuration of a charge pump circuit.

DESCRIPTION OF THE PREFERRED EMBODIMENTS

Preferred embodiments of the invention will be hereinafter described referring to the accompanying drawings.

Figure 1:
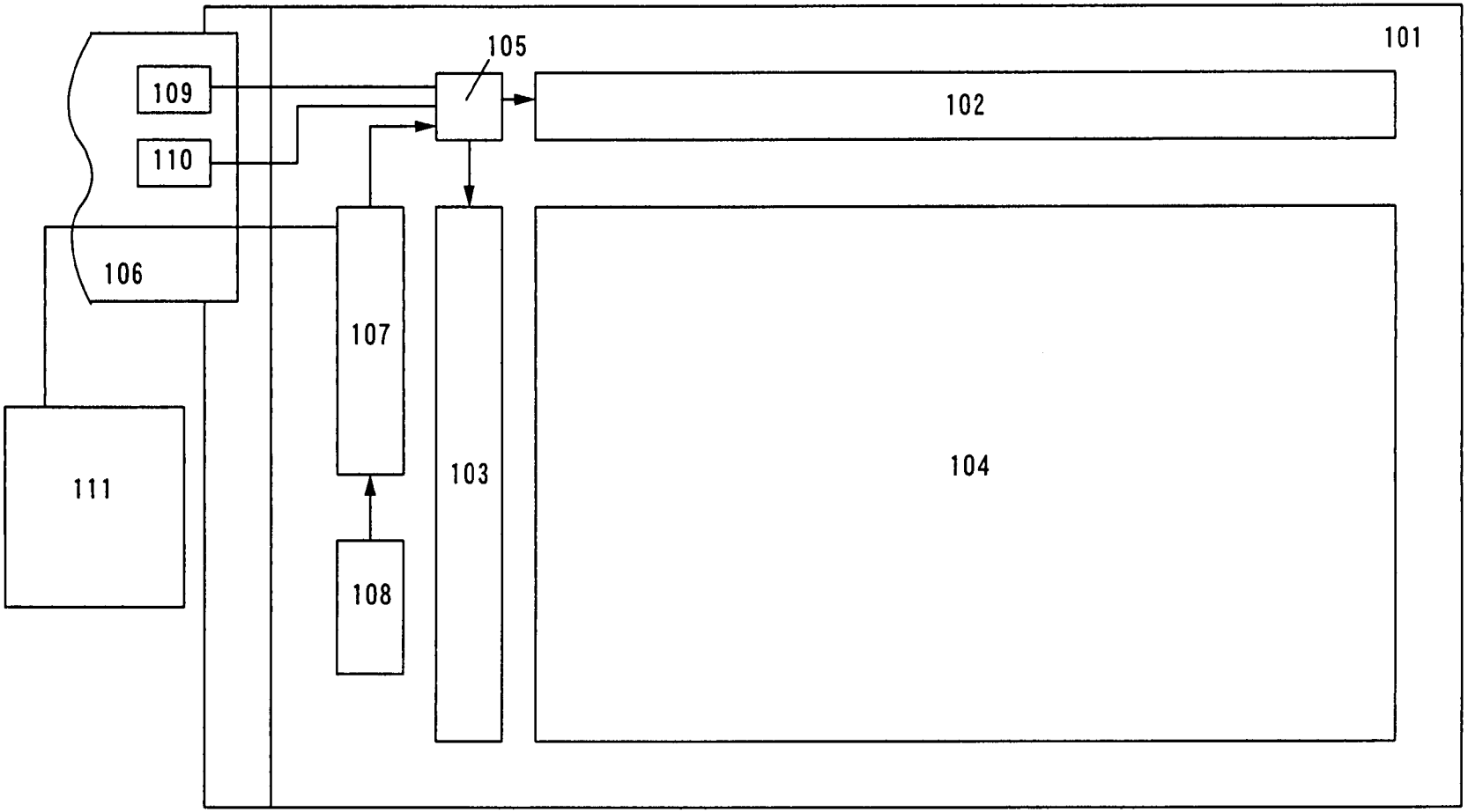
FIG. 1 is an outline view of a display device of the invention.
Figure 4A:
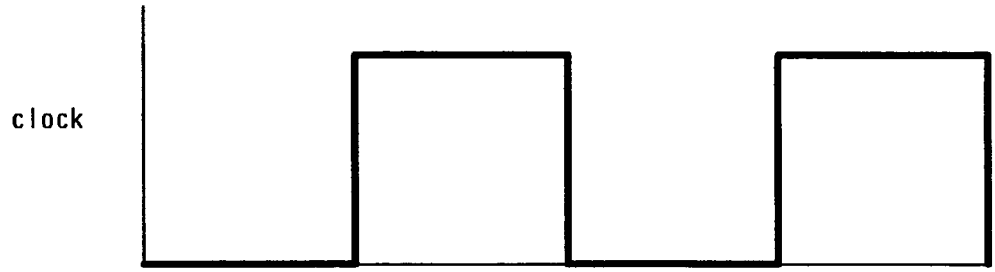
FIGS. 4A to 4C are charts showing the time shift of an output from a charge pump circuit.
Figure 4B:
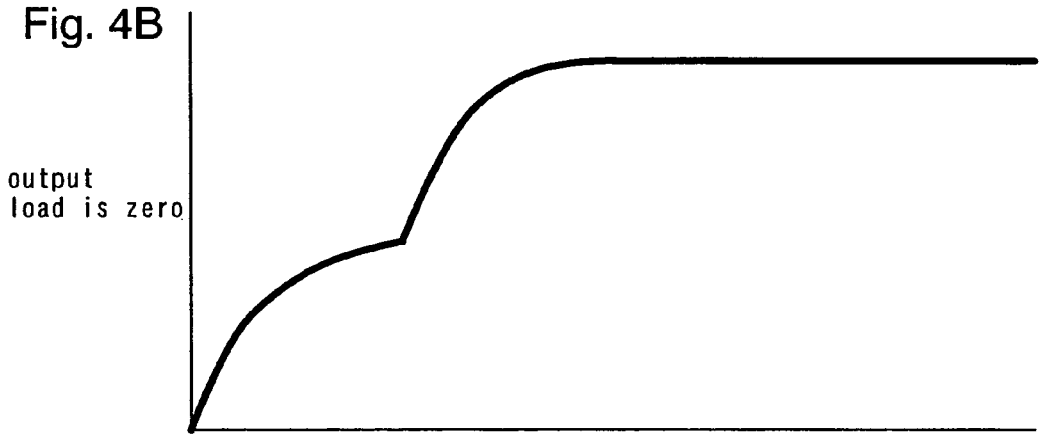
Figure 4C:
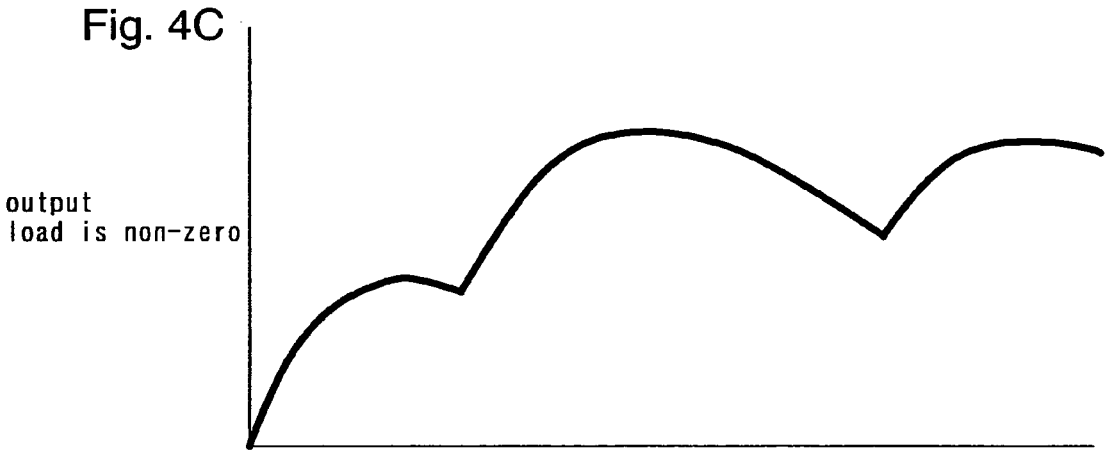
Figure 5A:
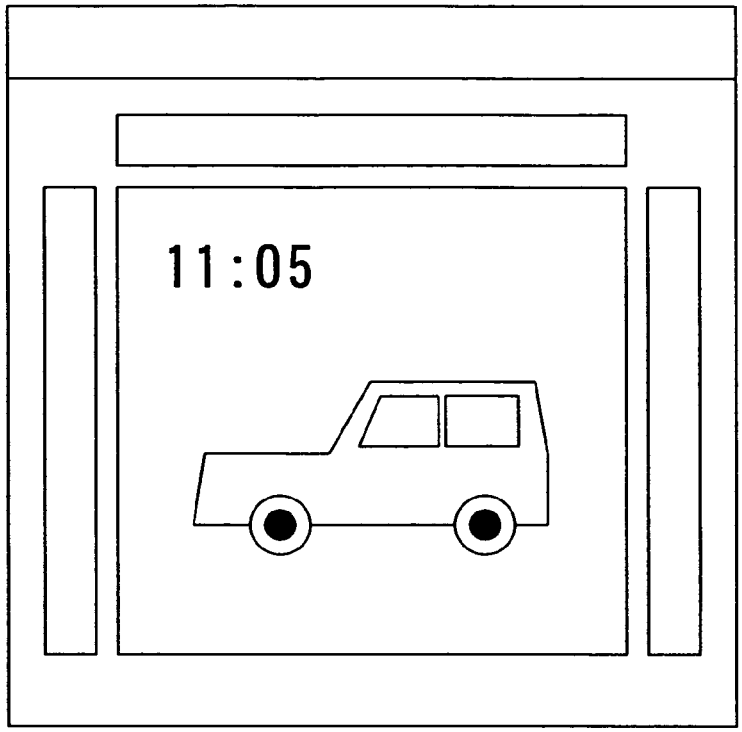
FIGS. 5A and 5B are views showing display modes of a display device.
Figure 5B:
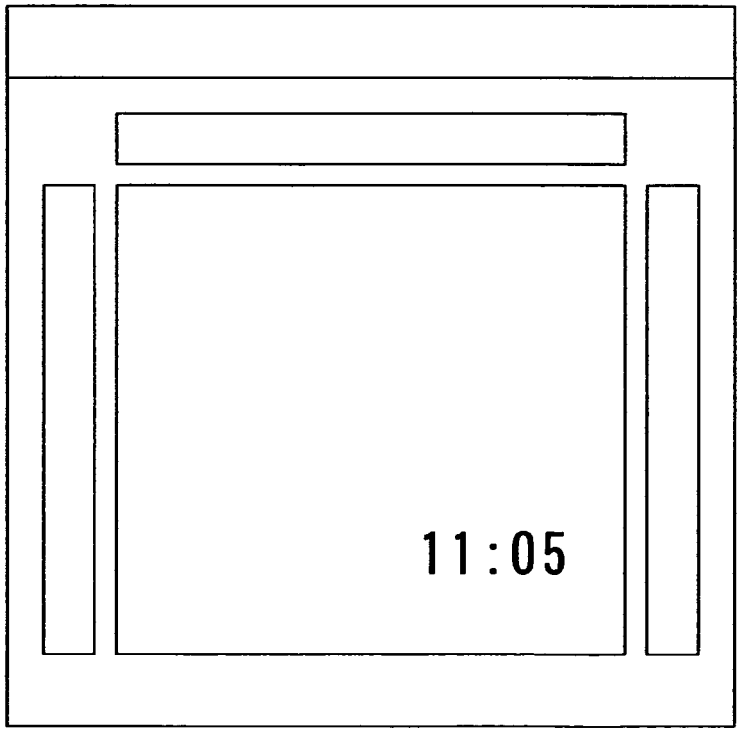

FIG. 1 shows an outline view of a display device of the invention. A display device 101 of the invention has a pixel portion 104, a source signal line driving circuit 102, a gate signal line driving circuit 103, a switching element 105, a variable frequency-dividing circuit 107 and a CPU 108 formed integrally with TFTs on a substrate 101. Also, an FPC 106 has capacitors 109 and 110. The capacitors are loaded on the FPC here, but the place is not limited to the FPC. They can be loaded on the substrate 101 or other substrates such as a glass substrate, a plastic substrate, a stainless substrate, a silicon substrate. A clock generator 111 is provided outside the substrate 101.

The operation of the invention will be hereinafter described. As described above, a display device using a conventional charge pump circuit has a problem in that the power consumption becomes relatively big when the display device is in a power-saving mode because a clock frequency for driving a switching element of the charge pump circuit is fixed.

According to the invention, the clock frequency for driving the switching element of the charge pump circuit is controlled by the variable frequency-dividing circuit 107 and the CPU 108 formed on the substrate. When a normal display operation is performed by the display device, a dividing ratio of the variable frequency-dividing circuit 107 is set low by the CPU 108 and the switching element 105 is driven at a high clock frequency. For this reason, the switching element is driven with a constant output voltage of the charge pump. On the other hand, when the display device is in the power-saving mode, the dividing ratio of the variable frequency-dividing circuit 107 is set high by the CPU 108. Therefore, the power consumption of the charge pump circuit can be kept low. The invention can be applied to a liquid crystal display device and an EL display device or the like.

Figure 6:
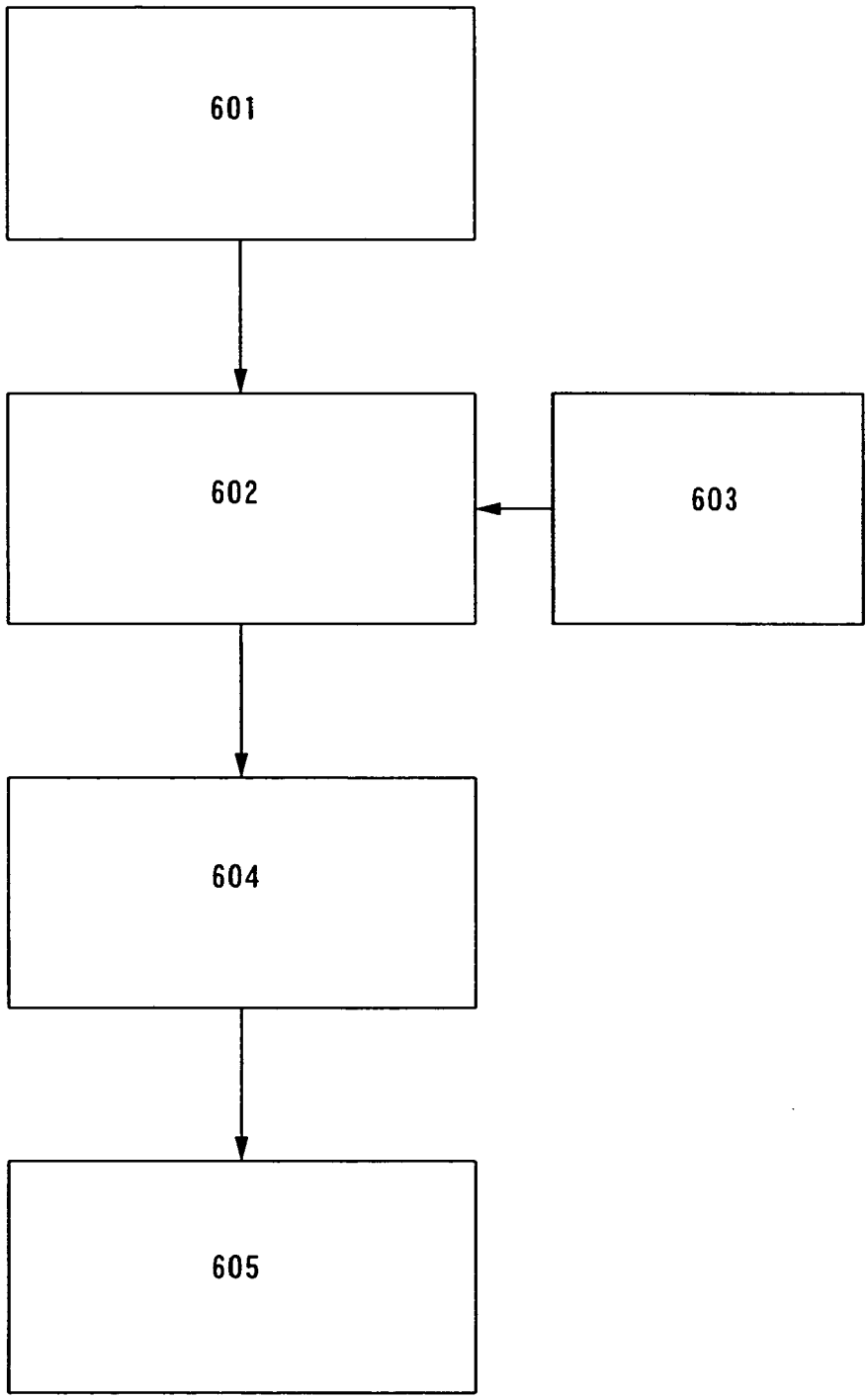
FIG. 6 is a block diagram of a charge pump control circuit of the invention.

FIG. 6 is a block diagram of a charge pump control circuit of the invention. The charge pump control circuit shown in FIG. 6 is constituted of a clock generator 601, a variable frequency-dividing circuit 602, a CPU 603, a charge pump circuit 604 and a signal line driving circuit 605. A signal from the clock generator 601 is inputted to the variable frequency-dividing circuit 602, and the CPU 603 controls the variable frequency-dividing circuit 602. Then, an output of the variable frequency-dividing circuit 602 is inputted to the charge pump circuit 604, and the charge pump circuit 604 supplies a voltage to the signal line driving circuit 605.

Embodiment 1

Figure 7:
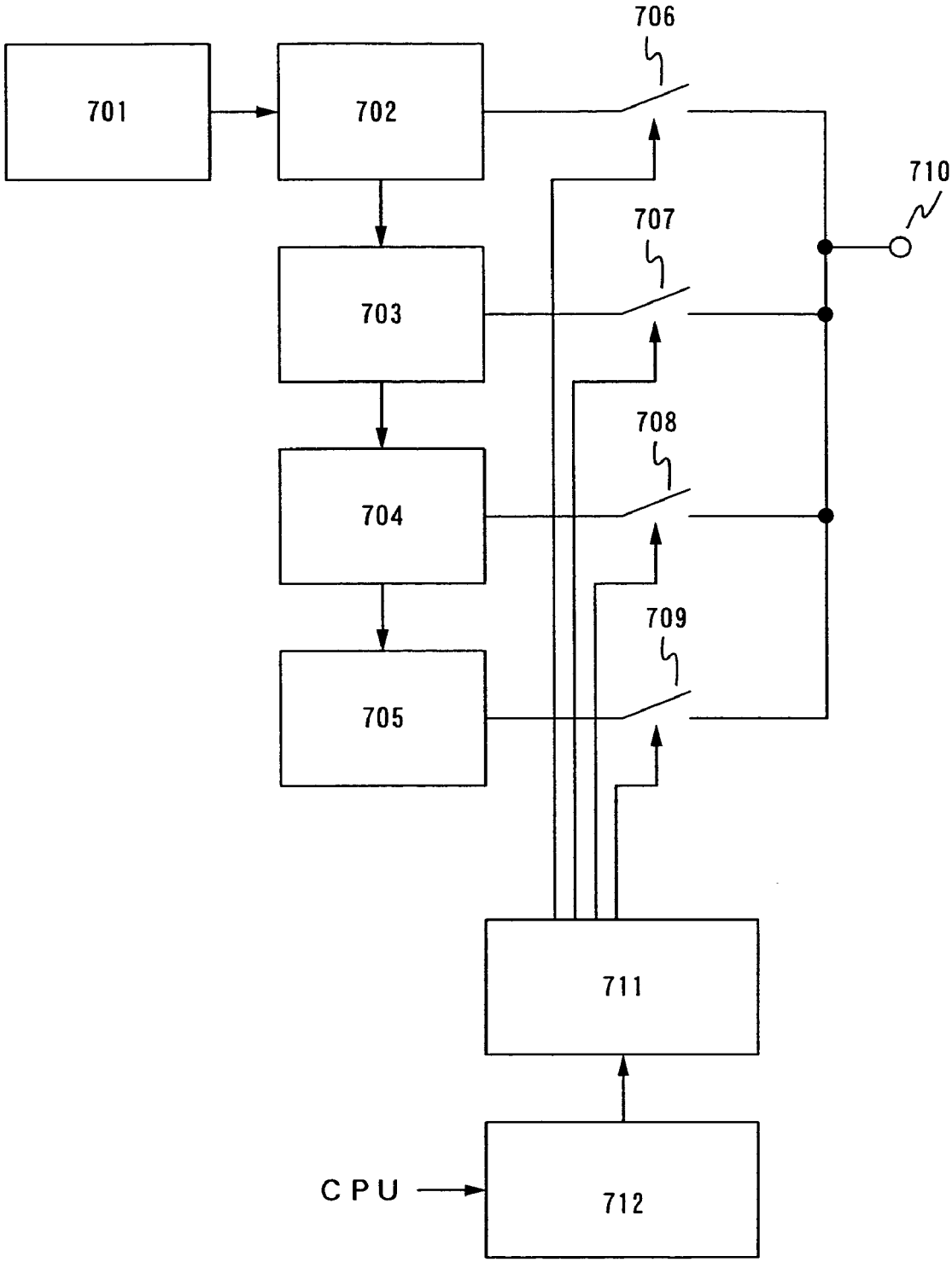
FIG. 7 is a block diagram of a variable frequency-dividing circuit of the invention.

FIG. 7 shows a block diagram of a variable frequency-dividing circuit. The variable frequency-dividing circuit shown in FIG. 7 is constituted of dividing circuits 702 to 705 which divide a frequency of a clock generator 701, switches 706 to 709 which select one of the output from the dividing circuits, a decoder 711 which controls the switches 706 to 709 and a latch circuit 712 which inputs control data from the CPU to the decoder.

First, a signal from the clock generator 701 is inputted to the dividing circuit 702. Then, a frequency becomes ½ and when the signal is inputted to the next dividing circuit 703, the frequency further becomes ½. In this manner, the frequency can be reduced up to 1/16 at the output of the dividing circuit 705. Next, the control data from the CPU is stored at the latch circuit 712. By the control data, the decoder 711 selects one of the switches 706 to 709 and outputs a signal at a pulse output terminal 710. In this way, ½ to 1/16 of the frequency from the pulse generator can be selected at the pulse output terminal.

As above, the switching circuit of the charge pump can be driven at an optimal clock frequency according to a display mode of the display device by using a variable frequency-dividing circuit of the invention. Additionally, the stability of an output voltage during a normal display operation and the reduction in power consumption during a power-saving mode can be compatibly achieved.

Embodiment 2

Figure 9:
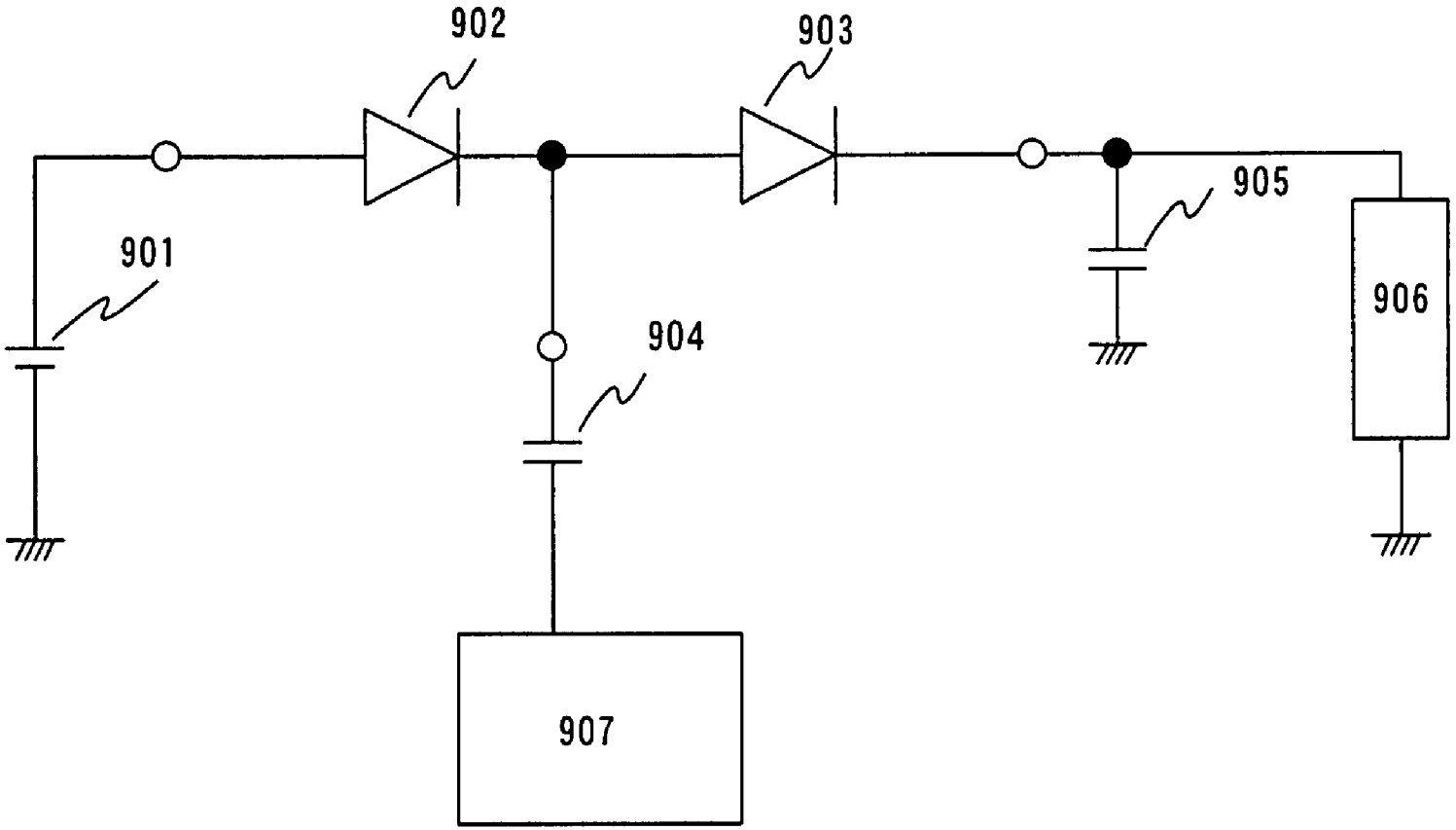
FIG. 9 is a configuration of a charge pump circuit in which PIN diodes of the invention are used.

FIG. 9 shows an embodiment where PIN diodes formed of TFTs are used as switching elements. The operation is the same as the case where MOS transistors are used as shown in FIG. 3. The operation will be hereinafter described. First, a voltage of a power source 901 is applied to a capacitor 904 via a switching element 902. In the case where the voltage of the power source 901 is referred to as VDD and the voltage of the switching element is taken as VF, a voltage of VDD-VF is applied to the both ends of the capacitor 904 when an output of a clock generator 907 is Lo. Next, when the output of the clock generator is Hi, a charge of the capacitor is applied to a load 906 and a capacitor 905 via a switching element 903. When the current flowing in the load is small enough, the charge of the capacitor 904 is retained, thereby a voltage of 2VDD-2VF generates at the both ends of the capacitor 905. In case of VDD>>VF, a voltage of nearly second times as high as VDD is generated in the load. Accordingly, a higher voltage than the original one can be obtained by using a charge pump.

With respect to a MOS transistor, a current on ON side is largely influenced by a threshold voltage of the MOS transistor. Particularly, in a thin film transistor, the fluctuation of the threshold voltage is big, thus an output voltage of the charge pump circuit becomes big in fluctuation under the influence of the threshold of the transistor. However, when a PIN diode is used, there is an advantage in that the fluctuation on ON side is small because the current is controlled by using a junction.

Therefore, a PIN diode can be effectively applied to a circuit such as a charge pump circuit which needs a diode characteristic.

Figure 8:
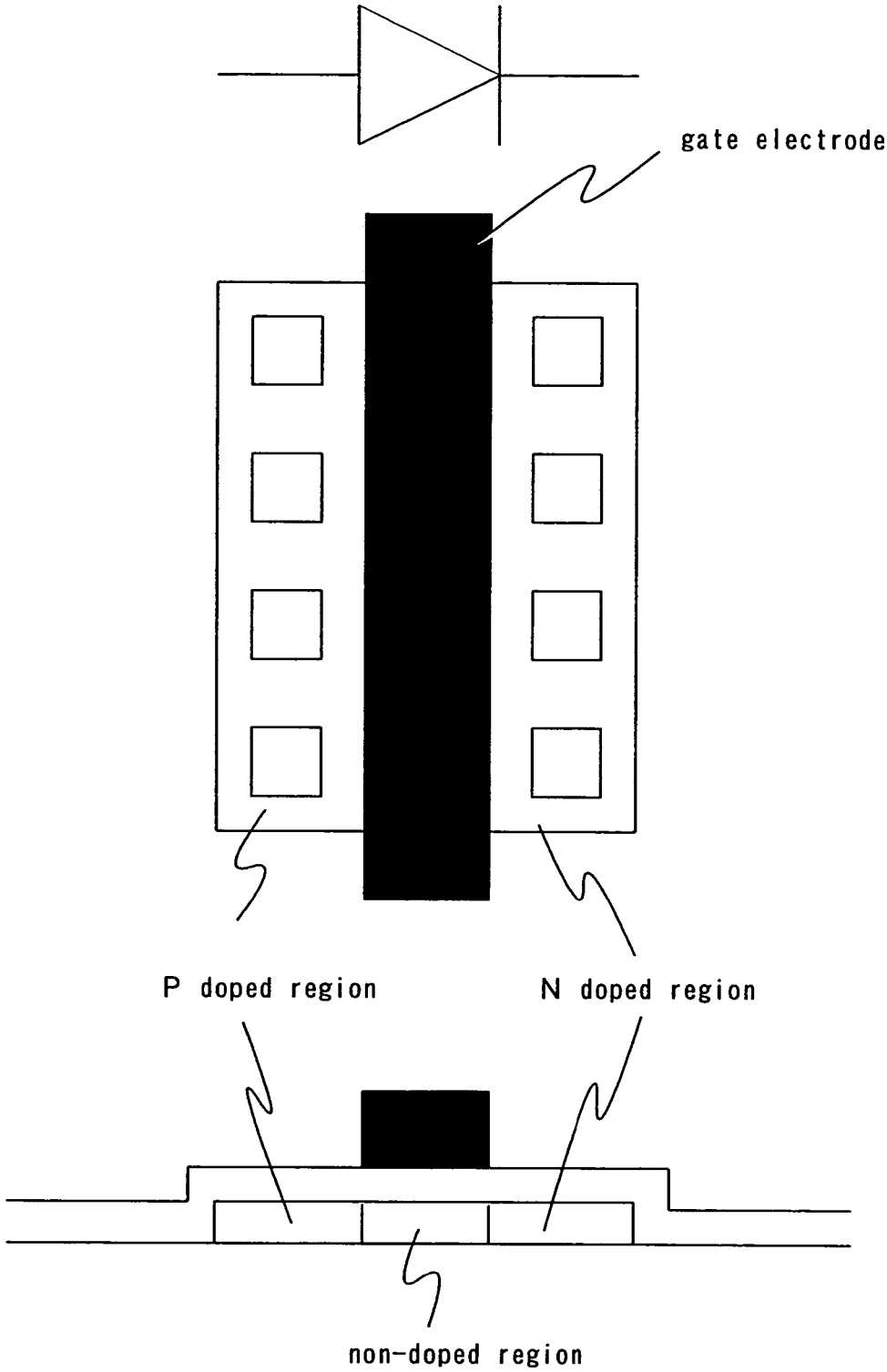
FIG. 8 is a view of a PIN diode of the invention.

FIG. 8 shows a specific embodiment of a PIN diode. Any additional configuration is not required for the PIN diode because it is formed by the same process as that of a normal thin film transistor. It can be formed by selectively doping an N-type impurity on the right side and a P-type impurity on the left side across a gate electrode. Meanwhile, a region directly under the gate electrode is not doped.

Further, this embodiment can be applied in combination with the foregoing embodiment.

Embodiment 3

A display device according to the foregoing embodiments can be used as display portions of various electronic equipment. Such electronic equipment incorporating the display device according to the invention as a display medium is described below.

Examples of the electronic equipment include video cameras, digital cameras, head mounted displays (goggle type displays), game machines, car navigation systems, personal computers, portable information terminals (mobile computers, mobile phones, and electronic books, etc.) Specific examples of these electronic equipment are shown in FIG. 10.

Figure 10A:
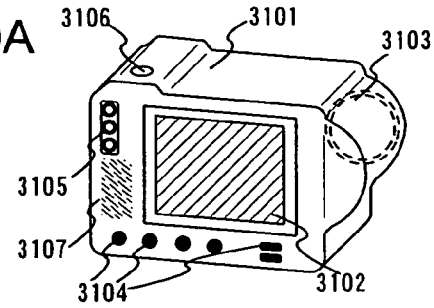
FIGS. 10A to 10G show examples of electronic equipment to which the invention can be applied.

FIG. 10A is a digital camera, which is composed of a main body 3101, a display portion 3102, an image-receiving portion 3103, operation keys 3104, an external connection port 3105, a shutter 3106, and the like. The display device of the invention can be used in the display portion 3102.

Figure 10B:
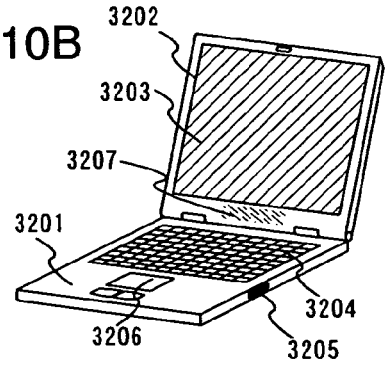

FIG. 10B is a notebook type personal computer, which is composed of a main body 3201, a frame 3202, a display portion 3203, a keyboard 3204, an external connection port 3205, a pointing mouse 3206, and the like. The display device of the invention can be used in the display portion 3203.

Figure 10C:
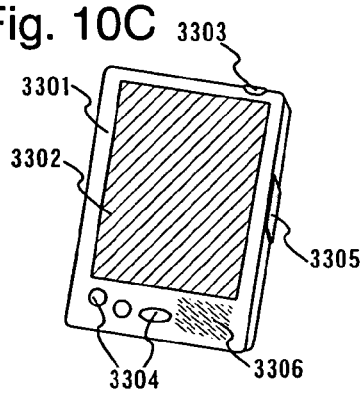

FIG. 10C is a PDA, which is composed of a main body 3301, a display portion 3302, a switch 3303, operation keys 3304, an infrared port 3305, and the like. The display device of the invention can be used in the display portion 3302.

Figure 10D:
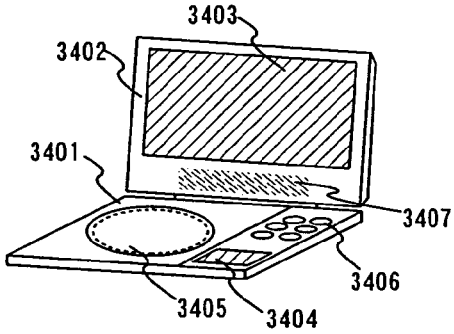

FIG. 10D is an image reproduction device provided with a recording medium (specifically, a DVD playback device), which is composed of a main body 3401, a frame 3402, a recording medium (such as CD, LD, DVD), read-in portion 3405, operation keys 3406, a display portion (a) 3403, a display portion (b) 3404, and the like. The display portion (a) 3403 mainly displays image information, and the display portion (b) 3404 mainly displays character information, and the display device of the invention can be used in the display portion (a) 3403 and in the display portion (b) 3404. Note that the invention may be used to CD reproduction devices, and game machines for domestic use and the like as the image reproduction devices provided with recording mediums.

Figure 10E:
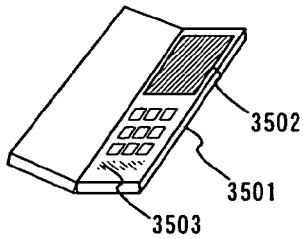

FIG. 10E is a folding portable information device. The invention can be used in a display portion 3502 in a main body 3501.

Figure 10F:
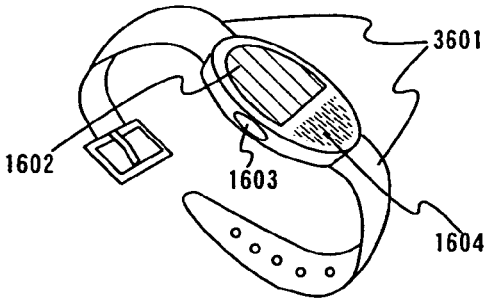

FIG. 10F is a watch type display device, which is composed of a display portion 1602, bands 3601, an operation switch 1603, an audio output portion 1604, or the like. The display device of the present invention can be used in the display portion 1602.

Figure 10G:
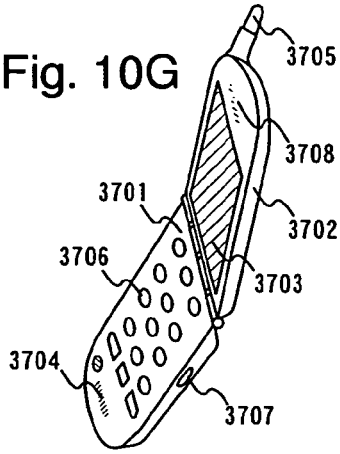

FIG. 10G is a mobile phone, which is composed of a main body 3701, a frame 3702, a display portion 3703, an audio input portion 3704, an antenna 3705, operation keys 3706, an external connecting port 3707, and the like. The display device of the present invention can be used in the display portion 3703.

As described above, an application range of the invention is so wide that the invention can be applied to electronic equipment in various fields. The electronic equipment in this embodiment can be provided in a structure of the combination of Embodiments 1 and 2.

In the conventional display device, there is a problem in that the power consumption becomes big when a display mode is changed since a clock frequency for driving a switching element for an incorporated charge pump circuit is fixed.

The invention makes it possible for the clock frequency of a switching element for a charge pump to be selected according to a display mode by integrally forming a charge pump control circuit with TFTs on a TFT substrate. Thus, it makes contribution to reduction in power consumption.

What is claimed is:

1. A display device comprising:

a substrate:

a pixel portion comprising a plurality of pixels formed over the substrate;

a driving circuit formed over the substrate, which controls the pixel portion;

a charge pump circuit which supplies a voltage to the driving circuit, the charge pump circuit comprising:

a switching element formed over the substrate; and a capacitor; and a charge pump control circuit towed over the substrate, which controls the charge pump circuit, the charge pump control circuit comprising:

a variable frequency-dividing circuit formed over the substrate comprising:

a plurality of dividing circuits formed over the substrate;

a plurality of switches electrically connected to the plurality of dividing circuits; and a decoder for controlling the plurality of switches; and a processing circuit formed over the substrate, which controls the variable frequency-dividing circuit.

2. A display device according to claim 1, wherein the charge pump control circuit can vary a clock frequency to input to the switching element.

3. A display device according to claim 1, wherein the clock frequency is controlled by the processing circuit.

4. A display device according to claim 1, wherein the processing circuit comprises a thin film transistor.

5. A display device according to claim 1, wherein the display device is a liquid crystal display device.

6. A display device according to claim 1, wherein the display device is an EL display device.

7. A display device according to claim 1, wherein the display device is applied to an electrical equipment selected from the group consisting of a digital camera, a notebook type personal computer, a PDA, a DVD playback device, a folding portable information device, a watch type display device and a mobile phone.

8. A display device according to claim 1, wherein the switching element is a transistor.

9. A display device according to claim 8, wherein the transistor is a thin film transistor.

10. A display device according to claim 1, wherein the switching element is a diode.

11. A display device according to claim 10, wherein the diode is a PIN diode.

12. A display device comprising:

a pixel portion comprising a plurality of pixels formed over a substrate;

a charge pump circuit;

a charge pump control circuit formed over the substrate, which controls the charge pump circuit, the charge pump control circuit comprising:

a variable frequency-dividing circuit including a first thin film transistor formed over the substrate, the variable frequency-dividing circuit comprising:

a plurality of dividing circuits formed over the substrate;

a plurality of switches electrically connected to the plurality of dividing circuits; and a decoder for controlling the plurality of switches; and a CPU comprising a second thin film transistor formed over the substrate, wherein the variable frequency-dividing circuit is controlled by the CPU, and wherein a dividing ratio is varied according to a display mode.

13. A display device according to claim 12, wherein the display device is a liquid crystal display device.

14. A display device according to claim 12, wherein the display device is an EL display device.

15. A display device according to claim 12, wherein the display device is applied to an electrical equipment selected from the group consisting of a digital camera, a notebook type personal computer, a PDA, a DVD playback device, a folding portable information device, a watch type display device and a mobile phone.

16. A display device according to claim 12, wherein the variable frequency-dividing circuit further comprises a plurality of dividing circuits, a plurality of switches electrically connected to the plurality of dividing circuits, and a decoder for controlling the plurality of switches.

* * * * *